US011565542B2

(12) United States Patent
Ishida

(10) Patent No.: US 11,565,542 B2
(45) Date of Patent: Jan. 31, 2023

(54) PRINTING DEVICE

(71) Applicant: SEIKO EPSON CORPORATION, Tokyo (JP)

(72) Inventor: Tetsugo Ishida, Yamagata-mura (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 17/356,169

(22) Filed: Jun. 23, 2021

(65) Prior Publication Data

US 2021/0402816 A1 Dec. 30, 2021

(30) Foreign Application Priority Data

Jun. 30, 2020 (JP) ..... JP2020-112528

(51) Int. Cl.
*B41J 29/13* (2006.01)
*B41J 29/393* (2006.01)

(52) U.S. Cl.
CPC ..... *B41J 29/393* (2013.01); *B41J 29/13* (2013.01)

(58) Field of Classification Search
CPC ..... B41J 3/36; B41J 3/39; B41J 3/4075; B41J 29/13; B41J 29/02; B41J 29/00
See application file for complete search history.

(56) References Cited

U.S. PATENT DOCUMENTS 5,180,232 A * 1/1993 Chadima, Jr. ..... B60R 11/0241 361/679.56
9,908,350 B2 3/2018 Katayama et al.
10,150,309 B2 12/2018 Ishimori
2016/0257146 A1* 9/2016 Akahane ..... B41J 29/023
2017/0150812 A1 6/2017 Tomomatsu et al.
2019/0028598 A1 1/2019 Takano
2019/0176497 A1 6/2019 Okayasu et al.

FOREIGN PATENT DOCUMENTS

EP 3666537 A1 6/2020
JP 2017098444 A 6/2017

* cited by examiner

*Primary Examiner* — Scott A Richmond
(74) *Attorney, Agent, or Firm* — Chip Law Group

(57) ABSTRACT

A printing device includes: a casing having a cover configured to open and close; an operation unit provided in the casing, the operation unit not being exposed outside the casing when the cover is closed, the operation unit being exposed outside the casing when the cover is open; and a holding unit whose state switches to one of a hold state configured to hold an information processing device and a release state configured to release the information processing device, in response to an operation accepted by the operation unit.

8 Claims, 4 Drawing Sheets

PRINTING DEVICE

The present application is based on, and claims priority from JP Application Serial Number 2020-112528, filed Jun. 30, 2020, the disclosure of which is hereby incorporated by reference herein in its entirety.

BACKGROUND

1. Technical Field

The present disclosure relates to a printing device.

2. Related Art

Research and development on a printing device that prints an image on a recording paper drawn out of a paper roll has been underway.

In connection with this, a printing device having a casing that can hold an external information processing device is known, as described in JP-A-2017-098444.

The casing of the printing device as described in JP-A-2017-098444 has a member for holding an information processing device. A user can make the casing hold the information processing device by arranging the information processing device at a predetermined position in the casing and moving the member to a hold position to hold the information processing device. The user can also remove the information processing device from the casing by moving the member to a release position to release the information processing device. In the printing device, anyone can carry out such an operation on the member. Thus, in the printing device, using a key to fix the member so as not to move from the hold position enables only a person having the key to carry out an operation on the member. However, the user needs to lock and unlock the member with the key every time the user removes the information processing device from the printing device. This results in a reduction in user-friendliness and therefore is not desirable.

SUMMARY

An aspect of the present disclosure is directed to a printing device including: a casing having a cover configured to open and close; an operation unit provided in the casing, the operation unit not being exposed outside the casing when the cover is closed, the operation unit being exposed outside the casing when the cover is open; and a holding unit whose state switches to one of a hold state configured to hold an information processing device and a release state configured to release the information processing device, in response to an operation accepted by the operation unit.

DESCRIPTION OF EXEMPLARY EMBODIMENTS

Embodiment

An embodiment of the present disclosure will now be described with reference to the drawings.

Outline of Printing Device

First, an outline of a printing device according to the embodiment is described.

The printing device according to the embodiment has a casing, an operation unit, and a holding unit. The casing has a cover configured to open and close. The operation unit is provided in the casing. The operation unit is not exposed outside the casing when the cover is closed. The operation unit is exposed outside the casing when the cover is open. The state of the holding unit switches to one of a hold state configured to hold an information processing device and a release state configured to release the information processing device, in response to an operation accepted by the operation unit.

Thus, the printing device according to the embodiment can make it easier to attach and remove the information processing device to and from the printing device and can restrain unintended removal of the information processing device from the printing device. Therefore, the printing device can improve both security and user-friendliness. The configuration of the printing device will now be described in detail.

Configuration of Printing Device

In the description below, the configuration of the printing device according to the embodiment is described, using a printing device 1 as an example of the printing device according to the embodiment.

Figure 1:
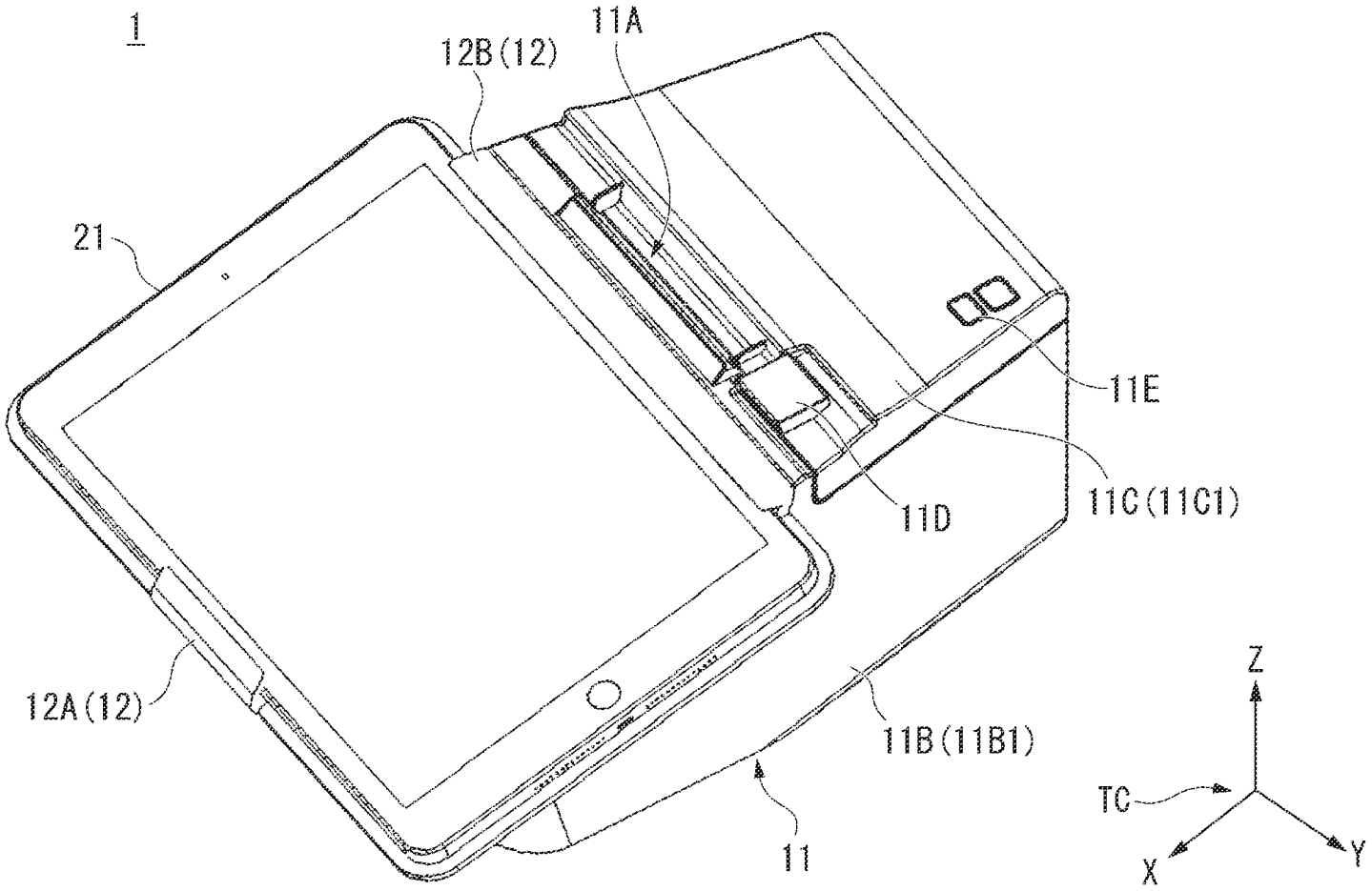
FIG. 1 is a perspective view of a printing device 1.

FIG. 1 is a perspective view of the printing device 1.

In the description below, a direction in the illustration is described using a three-dimensional coordinate system TC. The three-dimensional coordinate system TC is a three-dimensional orthogonal coordinate system representing a direction in each illustration where the three-dimensional coordinate system TC is drawn. In the description below, for the sake of description, an X-axis in the three-dimensional coordinate system TC is simply referred to as the X-axis. In the description below, for the sake of description, a Y-axis in the three-dimensional coordinate system TC is simply referred to as the Y-axis. In the description below, for the sake of description, a Z-axis in the three-dimensional coordinate system TC is simply referred to as the Z-axis.

Also, in the description below, for example, a case where the negative direction along the Z-axis coincides with the direction of gravity is described. In the description below, for the sake of description, the positive direction along the Z-axis is referred to as an upward direction or simply as up, and the negative direction along the Z-axis is referred to as a downward direction or simply as down. In the description below, for the sake of description, the positive direction along the X-axis is referred to as a forward direction or simply as forward, and the negative direction along the X-axis is referred to as a rearward direction or simply as rear. In the description below, for the sake of description, the positive direction along the Y-axis is referred to as a right direction or simply as right, and the negative direction along the Y-axis is referred to as a left direction or simply as left.

The printing device 1 is a roll paper printer that prints on a recording paper drawn out of a paper roll formed of a rolled long recording paper. That is, the printing device 1 can accommodate a paper roll inside. The printing device 1 discharges a printed recording paper from a discharge port 11A provided in a printer case 11, which is the casing of the printing device 1.

In the printing device 1, the discharge port 11A is provided at a top side of the printer case 11. The printer case 11 also has a main body case 11B and a cover case 11C provided for the main body case 11B. The printer case 11 may be provided with another cover case in addition to or instead of the cover case 11C.

The main body case 11B is formed of a main body case cover made of a resin that forms an exterior of the main body case 11B, and a main body frame 11B1 to which the main body case cover is attached. The main body case 11B is a case that can accommodate a paper roll, of a plurality of cases forming the printer case 11. That is, the main body case 11B has a paper roll accommodation unit (paper roll holder) RH. In other words, the main body frame 11B1 covered by the main body case cover has the paper roll accommodation unit RH. The paper roll accommodation unit RH is a container that can accommodate a paper roll. The paper roll accommodation unit RH is provided with an opening part as a paper roll input port through which to take out a paper roll from the paper roll accommodation unit RH and to put a paper roll in the paper roll accommodation unit RH. The opening part may be simply referred to as an opening. The paper roll accommodation unit RH is fixed to at least one of the main body case cover and the main body frame 11B1 of the main body case 11B by a fastening member or the like so as not to be detached from the main body case 11B. The fastening member is, for example, a screw but may be another member that can fasten the paper roll accommodation unit RH to at least one of the main body case cover and the main body frame 11B1 of the main body case 11B.

Inside the main body frame 11B1 of the main body case 11B, a printing mechanism that draws out a recording paper from a paper roll accommodated in the paper roll accommodation unit RH and prints on the recording paper is provided. The printing mechanism includes, for example, a conveyor roller RR that draws the recording paper from the paper roll and conveys the recording paper, a printing unit HD that prints on the recording paper conveyed by a conveyor mechanism, and a cutting unit, not illustrated, that cuts the printed recording paper. In an example, the conveyor roller RR has another member attached thereto, not illustrated, that is necessary for conveying the recording paper. In an example, the printing unit HD includes a print head that prints on the recording paper. More specifically, the printing unit HD includes a thermal head. In an example, the cutting unit includes a cutter that cuts the recording paper with a first blade, which is a moving blade, and a second blade, which is a fixed blade. The printing mechanism may have a configuration that does not include the cutting unit.

The foregoing discharge port 11A is provided near the center of a top side of the main body case cover of the main body case 11B.

Also, an opening part H is provided as a paper roll input port at the top side of the main body case cover of the main body case 11B. The opening part H is located to the rear of the discharge port 11A at the top side of the main body case cover. The opening part H provided at the top side of the main body case cover can be sealed off by the cover case 11C functioning as a cover that covers the opening part H. Meanwhile, the opening part H sealed off by the cover case 11C can also be opened from the cover case 11C. That is, in the printing device 1, the opening part H provided at the top side of the printing device 1 is opened or sealed off by the cover case 11C. To this end, an open-close lever 11D is provided at the main body case 11B. When the open-close lever 11D is operated, the cover case 11C is unlocked. When unlocked, the cover case 11C can rotationally move about a predetermined axis of rotational movement, not illustrated. The axis of rotational movement may also be referred to as an axis of rotation.

The cover case 11C is formed of a case cover made of a resin that forms an exterior of the cover case 11C, and a cover frame 11C1 to which the case cover is attached. The cover case 11C is a case, of the cases forming the printer case 11, that is coupled to the main body case 11B via the foregoing predetermined axis of rotational movement and that can rotationally move about the axis of rotational movement. That is, the cover frame 11C1 of the cover case 11C is coupled to the main body frame 11B1 in such a way as to be able to rotationally move about the axis of rotational movement. Also, the cover case 11C is a case that rotationally move about the axis of rotational movement and thus plays the role of a door opening or sealing off the opening part H provided at the top side of the main body case cover of the main body case 11B. In other words, in the printing device 1, the cover case 11C is an openable and closable cover of the printer case 11. The cover case 11C may be configured to be coupled to the main body case 11B in such a way as to be able to rotationally move about the axis of rotational movement via a jig or member that is separate from the cover case 11C, or may be configured to be coupled to the main body case 11B in such a way as to be able to rotationally move about the axis of rotational movement via a part of the cover case 11C.

At an end part opposite to an end part having the axis of rotational movement of the cover case 11C, of the end parts of the cover case 11C, the conveyor roller RR conveying the recording paper drawn out of the paper roll is provided. In other words, the conveyor roller RR is provided at an end part opposite to an end part having the axis of rotational movement of the cover case 11C, of the end parts of the cover frame 11C1 of the cover case 11C. However, in FIG. 1, the conveyor roller RR is located inside the printer case 11 and therefore invisible. The conveyor roller RR faces the printing unit HD when the cover case 11C is closed. Thus, the printing device 1 can print on the recording paper by the printing unit HD while conveying the recording paper by the conveyor roller RR.

At the cover case 11C, a power switch 11E for turning on and off the power of the printing device 1 is provided. More specifically, the power switch 11E is provided at the cover case 11C in such a way that the power switch 11E is located at the top side of the printer case 11 when the cover case 11C seals off the opening part H provided at the top side of the main body case 11B. The power switch 11E may be configured to be provided at another position on the cover case 11C or may be configured to be provided at the main body case 11B. The power switch 11E may also be formed separately from the cover case 11C. Alternatively, at least a part of the power switch 11E may be integrated with the cover case 11C.

At the top side of the main body case 11B, a holding unit 12 that can hold an external information processing device 21, described later, is provided.

In the example shown in FIG. 1, the holding unit (holding mechanism) 12 is located to the front of the discharge port 11A at the top side of the main body case 11B. The holding unit 12 has a plurality of tab parts holding the information processing device 21. In the description below, for example, a case where the plurality of tab parts are two tab parts, that is, a first tab part 12A and a second tab part 12B as shown in FIG. 1, is described. The holding unit 12 switches to one of a hold state where at least one of the first tab part 12A and the second tab part 12B is moved to a hold position for the at least one and a release state where the at least one of the first tab part 12A and the second tab part 12B is moved to a predetermined release position for the at least one, in response to an operation accepted by the printing device 1 from the user. The tab part may also be referred to as a tab structure.

For example, when the first tab part 12A and the second tab part 12B are both movable, the hold state is a state where the first tab part 12A is moved to the hold position for the first tab part 12A and the second tab part 12B is moved to the hold position for the second tab part 12B. Also, for example, when the first tab part 12A is movable and the second tab part 12B is not movable, the hold state is a state where the first tab part 12A is moved to the hold position for the first tab part 12A. Meanwhile, for example, when the second tab part 12B is movable and the first tab part 12A is not movable, the hold state is a state where the second tab part 12B is moved to the hold position for the second tab part 12B.

When the first tab part 12A and the second tab part 12B are both movable, the release state is a state where the first tab part 12A is moved to the release position for the first tab part 12A and the second tab part 12B is moved to the release position for the second tab part 12B. Also, for example, when the first tab part 12A is movable and the second tab part 12B is not movable, the release state is a state where the first tab part 12A is moved to the release position for the first tab part 12A. Meanwhile, for example, when the second tab part 12B is movable and the first tab part 12A is not movable, the release state is a state where the second tab part 12B is moved to the release position for the second tab part 12B.

In the description below, for example, a case where the second tab part 12B, of the first tab part 12A and the second tab part 12B, is movable is described. In the example shown in FIG. 1, the first tab part 12A and the second tab part 12B are provided at the main body case 11B in such a way as to be opposite to each other across a predetermined arrangement surface where the information processing device 21 can be arranged, of the surface of the main body case 11B. In this example, the second tab part 12B is provided at the main body case 11B in such a way as to be slidable in directions toward and away from the first tab part 12A. In this example, the second tab part 12B is also provided at the main body case 11B in such a way as to be slidable in directions toward and away from the arrangement surface. That is, in this example, a position that is the nearest to the arrangement surface, of the positions to which the second tab part 12B is movable, is the hold position for the second tab part 12B. Also, in this example, a position that is the farthest from the arrangement surface, of the positions to which the second tab part 12B is movable, is the release position for the second tab part 12B.

As the second tab part 12B moves toward each of the first tab part 12A and the arrangement surface, the information processing device 21 arranged at the arrangement surface is tightly held by a tab of the second tab part 12B, a tab of the first tab part 12A, and the arrangement surface, and thus fixed so as not to move. The holding unit 12 can thus hold the information processing device 21. Meanwhile, as the second tab part 12B moves away from each of the first tab part 12A and the arrangement surface, the information processing device 21 is released. The holding unit 12 thus releases the information processing device 21 and enables the information processing device 21 to be removed from the predetermined arrangement surface.

Figure 2:
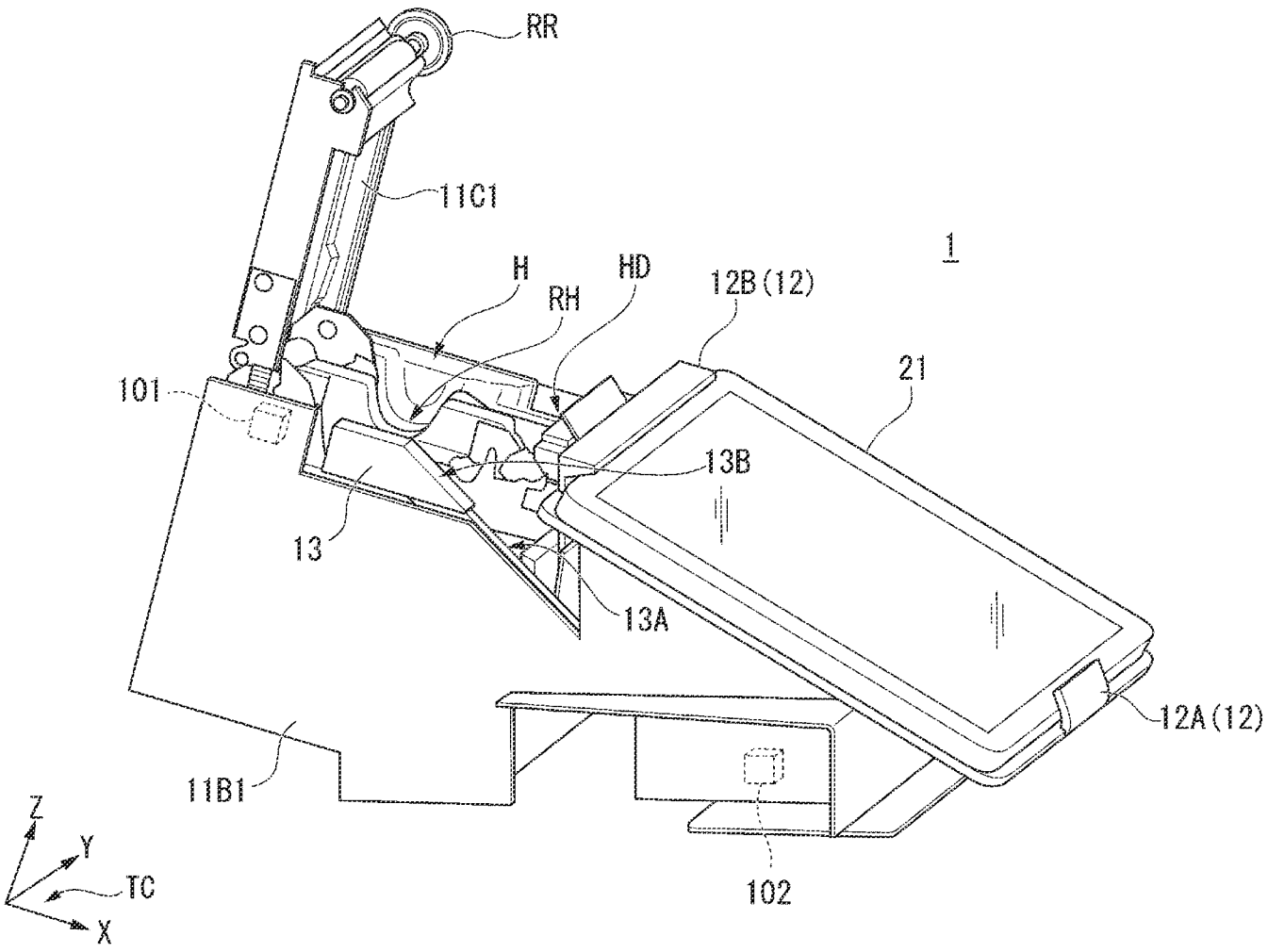
FIG. 2 shows an example of the state of the printing device 1 with a cover case 11C open.

FIG. 2 shows an example of the state of the printing device 1 with the cover case 11C open. However, in FIG. 2, in order to make the inside of the main body case 11B visible via the opening part H, the main body case cover is removed from the main body case frame 11B1 and the case cover is removed from the cover frame 11C1. In other words, FIG. 2 shows the printing device 1 in the state where a frame including the main body frame 11B1 with the main body case cover removed and the cover frame 11C1 with the case cover removed is exposed. In the example shown in FIG. 2, since the cover case 11C of the printing device 1 is open, the opening part of the paper roll accommodation unit RH is exposed via the opening part H. In this example, since no paper roll is accommodated in the paper roll accommodation unit RH, no paper roll is visible through the opening part of the paper roll accommodation unit RH. In the state where the cover case 11C is closed, the paper roll accommodation unit RH is sealed off by the cover case 11C.

As shown in FIG. 2, when the cover case 11C of the printing device 1 is open, an operation unit 13 provided in the printing device 1 is visible from outside the printing device 1. That is, the operation unit 13 is a member that can be operated from outside the printer case 11 when the cover case 11C is open. In other words, in this case, the operation unit 13 is exposed outside the printer case 11. The operation unit 13 is a member that accepts an operation from the user on the holding unit 12, of the members provided in the printing device 1. The operation unit 13 is provided inside the printer case 11, which is the casing of the printing device 1. The operation unit 13 is a member that cannot be operated from outside the printer case 11 when the cover case 11C is closed. In other words, in this case, the operation unit 13 is not exposed outside the printer case 11. The operation unit 13 may also be described as being sealed off by the cover case 11C in this case.

In the example shown in FIG. 2, the operation unit 13 is a lever. Therefore, in this example, when the operation unit 13, which is a lever, is flattened in relation to a predetermined direction, the second tab part 12B moves to the hold position and the state of the holding unit 12 switches to the hold state. In this example, when the operation unit 13 flattened in relation to the predetermined direction is raised up in relation to the predetermined direction, the second tab part 12B moves to the release position and the state of the holding unit 12 switches to the release state. In FIG. 2, in order to prevent the complexity of the illustration, a mechanism linking the operation unit 13 and the second tab part 12B is omitted. This mechanism may be any mechanism that can move the second tab part 12B to the hold position when the operation unit 13 is flattened in relation to the predetermined direction and that can move the second tab part 12B to the release position when the operation unit 13 is raised up in relation to the predetermined direction.

In the example shown in FIG. 2, the operation unit 13 is formed of an elongated rectangular-parallelepiped main body part 13A and a grip part 13B attached to a tip of the main body part 13A. Therefore, in this example, when the operation unit 13 is flattened in relation to the predetermined direction, the longitudinal direction of the main body part 13A of the operation unit 13 is parallel to the predetermined direction. The predetermined direction may be any direction. In the example shown in FIG. 2, the predetermined direction is a direction parallel to an XZ plane formed by the X-axis and the Z-axis. Therefore, the operation unit 13 can flatten or rise up in relation to the predetermined direction by rotationally moving about a predetermined axis of rotation parallel to the Y-axis.

As shown in FIG. 2, when the operation unit 13 rising up in relation to the predetermined direction is flattened in relation to the predetermined direction, the entirety of the operation unit 13 moves into the printer case 11. Therefore, when the cover case 11C is closed, the operation unit 13 is not visible from outside the printer case 11, as shown in FIG. 1. That is, in this case, the operation unit 13 is not exposed outside the printer case 11. Thus, a person who is not the user of the printing device 1 cannot grasp the position of the operation unit 13 in the printing device 1. This can restrain unintended removal of the information processing device 21 from the printing device 1 more securely. Meanwhile, when the cover case 11C is open, the entirety of the operation unit 13 is visible from outside the printer case 11. That is, in this case, the operation unit 13 is exposed outside the printer case 11. Thus, the user of the printing device 1 can easily operate the operation unit 13 by opening the cover case 11C. This can improve both the security and user-friendliness of the printing device 1. Also, a part of the operation unit 13 may be configured to be visible from outside the printer case 11 in this case. That is, a part of the operation unit 13 may be configured to be exposed outside the printer case 11 in this case.

Figure 3:
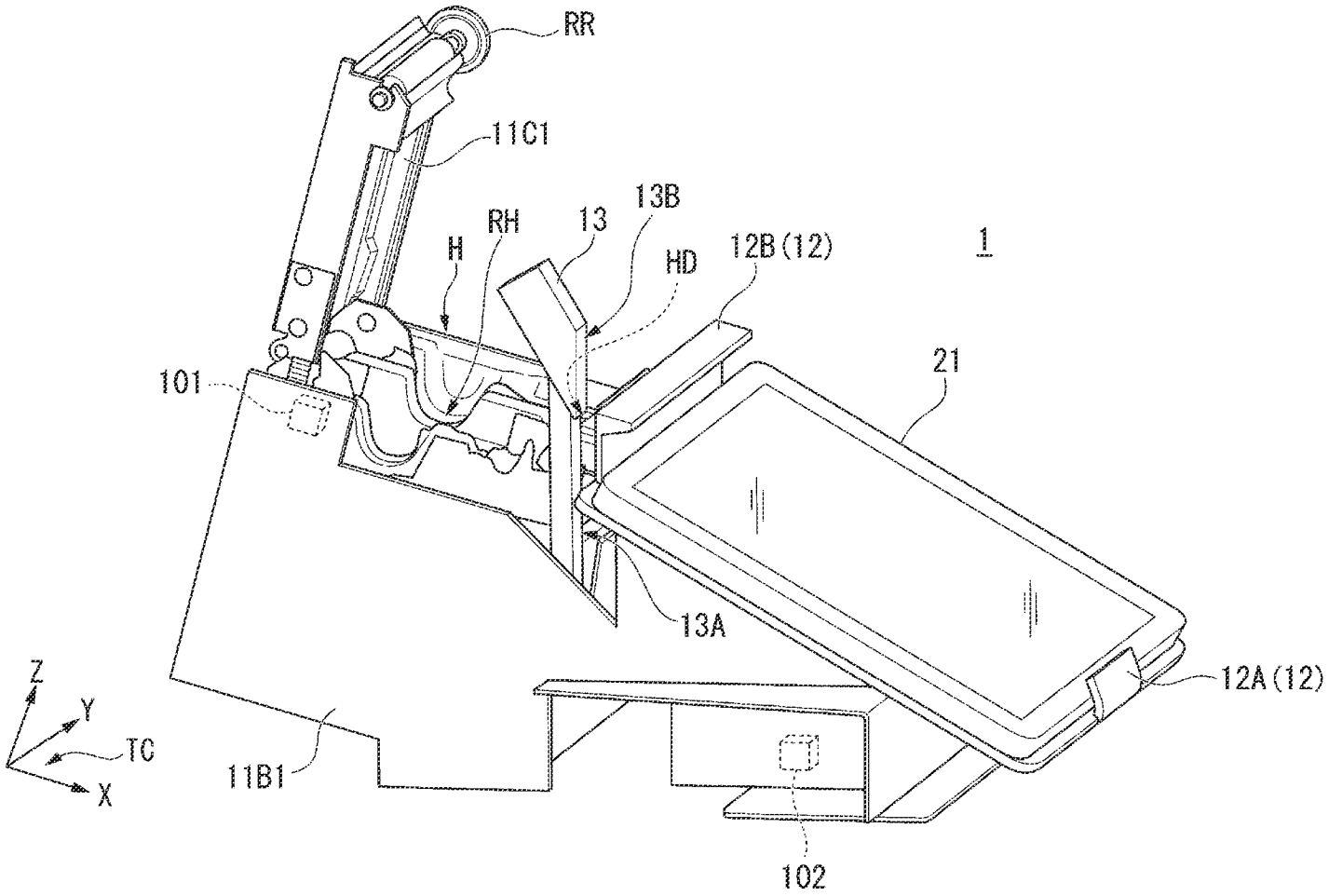
FIG. 3 shows an example of the state where an operation unit 13 of the printing device 1 shown in FIG. 2 is raised up in relation to a predetermined direction.

In this embodiment, as shown in FIG. 3, when the operation unit 13 flattened in relation to the predetermined direction is raised up in relation to the predetermined direction, a part of the operation unit 13 is located outside the printer case 11. In other words, in this case, apart of the operation unit 13 moves to outside the printer case 11 from inside the printer case 11. FIG. 3 shows an example of the state where the operation unit 13 shown in FIG. 2 is raised up in relation to the predetermined direction. Since a part of the operation unit 13 moves to outside the printer case 11 in this case, the user of the printing device 1 can easily grasp the state of the holding unit 12, based on whether the operation unit 13 is outside the printer case 11 or not. This can further improve the user-friendliness of the printing device 1. In FIG. 3, since the operation unit 13 is raised up in relation to the predetermined direction, the second tab part 12B is moved to the release position. That is, in FIG. 3, the holding unit 12 is in the release state. The printing device 1 may also be configured in such a way that the entirety of the operation unit 13 is located inside the printer case 11 when the operation unit 13 is raised up in relation to the predetermined direction. In other words, the printing device 1 may be configured in such a way that the entirety of the operation unit 13 does not move to outside the printer case 11 when the operation unit 13 is raised up in relation to the predetermined direction.

At the rear side of the main body case 11B, a space for accommodating a power supply device and a power cable or the like, not illustrated, is provided. However, in this embodiment, the description of the space is omitted.

The printing device 1 also has a detection unit 101 detecting that the cover case 11C is open or closed, and a control unit 102 controlling the printing device 1, as shown in FIGS. 2 and 3.

The detection unit 101 is, for example, a touch sensor. The detection unit 101 may be any sensor that can detect that the cover case 11C is open or closed. The detection unit 101 may be, for example, an optical sensor.

When detecting that the cover case 11C is open, the detection unit 101 outputs a signal indicating that the cover case 11C is open, to the control unit 102 of the printing device 1. Meanwhile, when detecting that the cover case 11C is closed, the detection unit 101 outputs a signal indicating that the cover case 11C is closed, to the control unit 102 of the printing device 1. This enables the control unit 102 of the printing device 1 to determine the state of the holding unit 12. That is, when the detection unit 101 detects that the cover case 11C is closed, the control unit 102 of the printing device 1 determines that the state of the holding unit 12 is the hold state. Meanwhile, when the detection unit 101 detects that the cover case 11C is open, the control unit 102 of the printing device 1 determines that the state of the holding unit 12 is the release state. Thus, the control unit 102 of the printing device 1 can report, for example, information representing the state of the holding unit 12 to the user of the printing device 1 via an image, sound, vibration, light or the like.

The control unit 102 is, for example, a CPU (central processing unit) controlling the entirety of the printing device 1. The control unit 102 of the printing device 1 may be another processor instead of the CPU.

Figure 4:
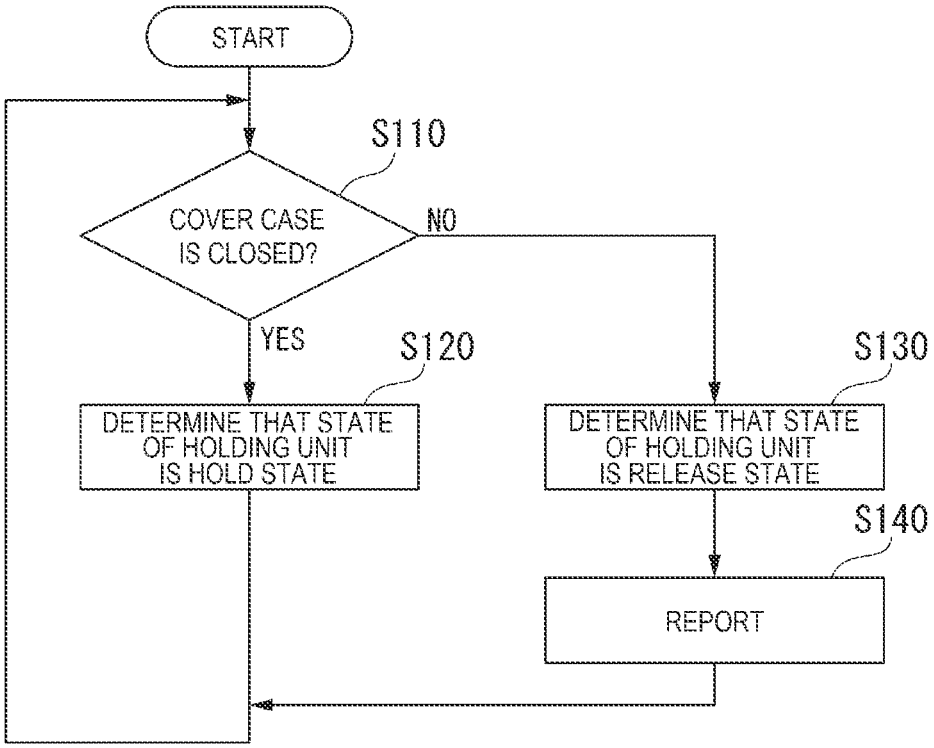
FIG. 4 shows an example of a flow of processing in which a control unit 102 determines the state of a holding unit.

FIG. 4 shows an example of a flow of processing in which the control unit 102 determines the state of the holding unit 12. The control unit 102 repeatedly executes, for example, the processing shown in the flowchart of FIG. 4 while the printing device 1 is active.

The control unit 102 determines whether the cover case 11C is closed or not, based on a signal outputted from the detection unit 101 (step S110).

When determining that the cover case 11C is closed (YES in step S110), the control unit 102 determines that the state of the holding unit 12 is the hold state (step S120). The control unit 102 then shifts to step S110 and determines again whether the cover case 11C is closed or not, based on an output from the detection unit 101.

Meanwhile, when determining that the cover case 11C is open (NO in step S110), the control unit 102 determines that the state of the holding unit 12 is the release state (step S130).

Next, the control unit 102 reports information to the effect that the state of the holding unit 12 is the release state, to the user of the printing device 1 (step S140). The control unit 102 then shifts to step S110 and determines again whether the cover case 11C is closed or not, based on an output from the detection unit 101. The control unit 102 may also report information to the effect that the cover case 11C is open instead of or in addition to the information to the effect that the state of the holding unit 12 is the release state, to the user of the printing device 1. The control unit 102 may also transmit and report these pieces of information to an external device coupled for communication with the printing device 1. The information to be reported may be, for example, a command or other information.

As described above, the printing device 1 determines the state of the holding unit 12, based on a signal outputted from the detection unit 101, and reports that the state of the holding unit 12 is the release state to the user of the printing device 1 when the state of the holding unit 12 is the release state. This further improves the security of the printing device 1.

The information processing device 21 held by the printing device 1 configured as described above is, for example, a tablet PC (personal computer). The information processing device 21 may be another terminal device such as a multi-functional mobile phone (smartphone) or a PDA (personal digital assistant) instead of the tablet PC. The information processing device 21 is, for example, a terminal device used by the user of the printing device 1. The user of the printing device 1 is, for example, an operator at a store but is not limited to this.

As described above, a printing device according to an embodiment includes: a casing having a cover configured to open and close; an operation unit provided in the casing, the operation unit not being exposed outside the casing when the cover is closed, the operation unit being exposed outside the casing when the cover is open; and a holding unit whose state switches to one of a hold state configured to hold an information processing device and a release state configured to release the information processing device, in response to an operation accepted by the operation unit. This can improve both the security and user-friendliness of the printing device. In the above-described example, the printing device 1 is an example of the printing device. In the above-described example, the cover case 11C is an example of the cover. In the above-described example, the printer case 11 is an example of the casing. In the above-described example, the operation unit 13 is an example of the operation unit. In the above-described example, the holding unit 12 is an example of the holding unit.

In the printing device, the operation unit may be a lever. The state of the holding unit may switch to the hold state when the lever is flattened in relation to a predetermined direction. The state of the holding unit may switch to the release state when the lever is raised up in relation to the predetermined direction.

In the printing device, when the lever flattened in relation to the predetermined direction is raised up, a part of the lever may move to outside the casing from inside the casing.

In the printing device, the holding unit may have a plurality of tab parts holding the information processing device. The state of the holding unit may switch to the hold state where at least a part of the plurality of tab parts is moved to a predetermined hold position for the part and the release state where the at least a part is moved to a predetermined release position for the part, in response to an operation accepted by the operation unit.

In the printing device, an accommodation unit configured to accommodate a paper roll may be provided inside the casing. The accommodation unit may be exposed outside the casing when the cover is open. The accommodation unit may be sealed off when the cover is closed. In the above-described example, the paper roll accommodation unit RH is an example of the accommodation unit.

The printing device may further include: a conveyor roller provided at an end part opposite to an end part having an axis of rotational movement of the cover, of end parts of the cover, the conveyor roller conveying a recording paper drawn out of the paper roll; and a printing unit configured to print on the recording paper. The printing unit may be provided inside the casing and may face the conveyor roller when the cover is closed. In the above-described example, the conveyor roller RR is an example of the conveyor roller. In the above-described example, the printing unit HD is an example of the printing unit.

The printing device may further include: a detection unit detecting that the cover is open or closed; and a control unit. The control unit may determine that the state of the holding unit is the hold state when the detection unit detects that the cover is closed. In the above-described example, the detection unit 101 is an example of the detection unit. In the above-described example, the control unit 102 is an example of the control unit.

An embodiment of the present disclosure has been described in detail with reference to the drawings. However, the specific configuration of the present disclosure is not limited to the embodiment. Various changes, replacements, deletions and the like can be made without departing from the spirit and scope of the present disclosure.

What is claimed is:

1. A printing device comprising:

a casing having a cover configured to be opened or closed;

an operation unit disposed in the casing, the operation unit being sealed off by the cover when the cover is closed, the operation unit being exposed outside the casing when the cover is opened;

a holding unit whose state switches to one of a hold state configured to hold an information processing device and a release state configured to release the information processing device, in response to an operation accepted by the operation unit;

a detection unit detecting that the cover is opened or closed; and a control unit that determines the state of the holding unit is the hold state when the detection unit detects that the cover is closed.

2. The printing device according to claim 1, wherein the operation unit is a lever, and the state of the holding unit switches to the hold state when the lever is flattened in relation to a predetermined direction, and the state of the holding unit switches to the release state when the lever is raised up in relation to the predetermined direction.

3. The printing device according to claim 2, wherein when the lever flattened in relation to the predetermined direction is raised up, a part of the lever moves to outside the casing from inside the casing.

4. The printing device according to claim 1, wherein the holding unit has a plurality of tab parts holding the information processing device, and the state of the holding unit switches to the hold state where at least a part of the plurality of tab parts is moved to a predetermined hold position for the part and the release state where the at least a part is moved to a predetermined release position for the part, in response to an operation accepted by the operation unit.

5. The printing device according to claim 1, wherein an accommodation unit configured to accommodate a paper roll is disposed inside the casing, and the accommodation unit is exposed outside the casing when the cover is opened, and the accommodation unit is sealed off when the cover is closed.

6. The printing device according to claim 5, further comprising:

a conveyor roller disposed the cover, the conveyor roller conveying a recording paper drawn out of the paper roll; and a printing unit configured to print on the recording paper, wherein the printing unit is disposed inside the casing and faces the conveyor roller when the cover is closed.

7. A printing device comprising:

a casing having a cover configured to be opened or closed;

an operation unit disposed in the casing, the operation unit being sealed off by the cover when the cover is closed, the operation unit being exposed outside the casing when the cover is opened; and a holding unit whose state switches to one of a hold state configured to hold an information processing device and a release state configured to release the information processing device, in response to an operation accepted by the operation unit, wherein the operation unit is a lever, and the state of the holding unit switches to the hold state when the lever is flattened in relation to a predetermined direction, and the state of the holding unit switches to the release state when the lever is raised up in relation to the predetermined direction.

8. A printing device comprising:

a casing having a cover configured to be opened or closed;

an operation unit disposed in the casing, the operation unit being sealed off by the cover when the cover is closed, the operation unit being exposed outside the casing when the cover is opened;

a holding unit whose state switches to one of a hold state configured to hold an information processing device and a release state configured to release the information processing device, in response to an operation accepted by the operation unit; and an accommodation unit configured to accommodate a paper roll, wherein the accommodation unit is inside the casing, the accommodation unit is exposed outside the casing when the cover is open, and the accommodation unit is sealed off when the cover is closed.

* * * * *